United States Patent [19]

Kaneyasu

[11] 4,090,044

[45] May 16, 1978

[54] CONTAINER FOR POSITIONING A DISINFECTANT-IMPREGNATED MEMBER IN A TELEPHONE MOUTHPIECE

[75] Inventor: Masao Kaneyasu, Tokyo, Japan

[73] Assignee: Dentsu Central Kabushiki Kaisha, Japan

[21] Appl. No.: 834,669

[22] Filed: Sep. 19, 1977

[51] Int. Cl.[2] ..... H04R 1/12

[52] U.S. Cl. ..... 179/185

[58] Field of Search ..... 179/185

[56] References Cited

FOREIGN PATENT DOCUMENTS 2,270,744 12/1975 France ..... 179/185

*Primary Examiner*—Thomas W. Brown

*Attorney, Agent, or Firm*—Watson, Cole, Grindle & Watson

[57] ABSTRACT

A container for positioning a flat ring-like disinfectant-impregnated member into a telephone mouthpiece comprises a container body and a lid member which can be interlocked to the container body and thereby retain the impregnated member therebetween. The lid member includes a plurality of circumferential triangular teeth which have their apexes projecting radially outwardly of the lid member, and the container body includes a plurality of upper and lower circumferential retaining pieces and a plurality of associated pawls and projections for interlocking the teeth of the lid member, and thus the lid member itself, to the container body.

4 Claims, 9 Drawing Figures

CONTAINER FOR POSITIONING A DISINFECTANT-IMPREGNATED MEMBER IN A TELEPHONE MOUTHPIECE

BACKGROUND OF THE INVENTION

1. Field of the Invention

The present invention relates to containers for disinfectant-impregnated members which are insertable in telephone mouthpieces, and more particularly to containers having improved means to interlock the lid member to the container body and thereby assure retention of the disinfectant-impregnated member in the telephone mouthpiece.

2. Description of the Prior Art

Due to the fact that public telephones are utilized by many different people, and due to the fact that saliva from some of these people can be retained upon the telephone mouthpieces, thereby creating an offensive smell and, in effect, contaminating the mouthpiece, it is known to place disinfectant-impregnated members into the mouthpieces in order to both disinfect the mouthpieces and provide an agreeable frangrance thereto. Such disinfectant-impregnated members have been supported within removable containers such as shown in U.S. Pat. No. 3,643,040 of Feb. 15, 1972.

However, over a period of time the disinfectant-impregnated members will lose their potency and will therefore require replacement. For this reason, the prior art containers have been designed such that a lid member is readily separated from a container housing so that the retained disinfectant-impregnated member can be easily replaced.

However, the prior art containers have been so constructed that with frequent use of the telephone, the lid members have been easily loosened and separated from the container bodies, such that the disinfectant-impregnated members have too easily been dislocated from their intended positionings within the mouthpieces.

According to the present invention, however, the lid member and the container body of the container are so constructed that they can be fixedly and permanently locked together, such that the disinfectant-impregnated member will be prevented from slipping off the supporting container body.

Also according to the present invention, the container itself is constructed so as to be sufficiently inexpensive as compared to the cost of the retained disinfectant-impregnated member that the entire container (with exhaused disinfectant-impregnated member) can be removed from the telephone mouthpiece and discarded without economic disadvantage.

SUMMARY OF THE INVENTION

The container of the present invention comprises a container body and a lid member which fits into the container body, the container body including a central circular opening allowing for transmission of a speaker's conversation into a telephone mouthpiece, a peripheral annular portion capable of supporting and retaining a flat, ring-shaped disinfectant-impregnated member; and the lid member being reticulated in structure and of a size large enough to cover the central circular opening of the container body as well as the peripheral retaining portion of the container body.

The lid member further includes at least two prongs provided in a central portion thereof which can extend through the central opening of the container body when the lid member is fitted in the container body, and a plurality of circumferentially, equi-angularly spaced, triangular teeth having their apexes extending radially outwardly of the lid member. The prongs are capable of connection to suitable retaining means within the telephone mouthpiece.

The container body further includes a plurality of cut-away portions for receiving therein the triangular teeth of the lid member, a plurality of upper and lower circumferentially spaced retaining portions adapted to engage the triangular teeth of the lid member in bayonet fashion (the number of retaining portions being equal to the number of triangular teeth), a plurality of small projections provided on the inner peripheral wall of the container under either the upper or lower retaining pieces which are adapted to abut portions of the triangular teeth on the lid member and thus prevent rotation of the lid member relative to the container body in a first rotational direction, and a plurality of inner circumferential triangular pawls having their apexes projecting radially inwardly of the container body which function to prevent rotation of the lid member relative to the container body in a direction opposite to the first rotational direction after the triangular teeth of the lid member have been forced to ride over the triangular pawls in the first rotational direction.

In order to assemble the inventive container so as to retain a disinfectant-impregnated member therein, the disinfectant-impregnated member is placed on a bottom portion of the container body and the lid member is placed thereon such that its peripheral triangular teeth are positioned in the cut-away portions of the container body. Thereafter, the lid member is rotated relative to the container body such that the peripheral triangular teeth ride over the triangular pawls so as to become locked in between the triangular pawls and the associated small projections, the upper and lower retaining means then concurrently preventing the lid member from separating from the container body.

The disinfectant-impregnated member is thus fixed in position within the container since there is no possibility of accidental separation from the container body, e.g., due to impacts applied to the telephone receiver.

The container body and lid member are fabricated from innocuous synthetic resins, such as plastic materials, which are of a quality acceptable for food contact. Thus, the materials making up the container are entirely sanitary, yet inexpensive enough that it can be discarded with a resultant economic loss of any significance to the user.

The removal and replacement of the container from a telephone mouthpiece is achieved with ease since the noted prongs on the lid member, when mounted in the mouthpiece, extend entirely through the central opening in the container body and fit into perforations in the telephone mouthpiece.

Further features of the present invention will be apparent from the following description which describes a preferred embodiment of the present invention.

DETAILED DESCRIPTION OF THE PREFERRED EMBODIMENT

Figure 1:
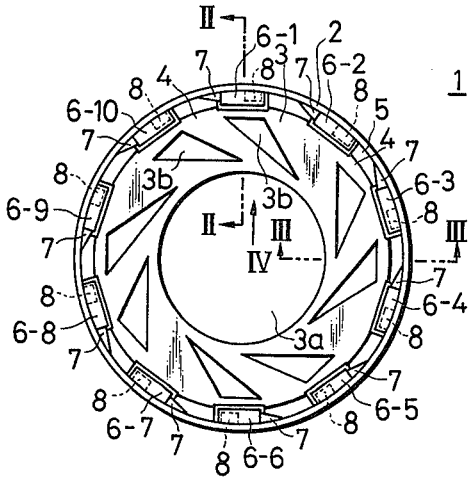
FIG. 1 shows a top plan view of a container body utilized as part of the container of the present invention.
Figure 2:
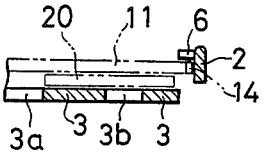
FIG. 2 shows a fragmentary cross sectional view of the container body of FIG. 1 taken along line II — II.
Figure 6:
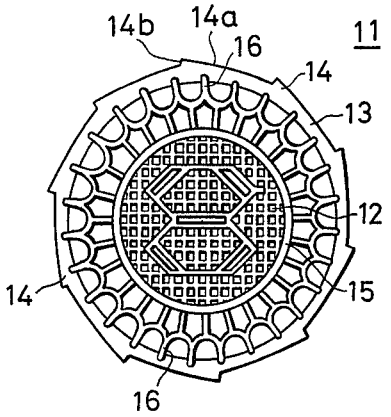
FIG. 6 shows a top plan view of a lid member member which cooperates with the container body of FIG. 1 to form the container of the invention.
Figure 9:
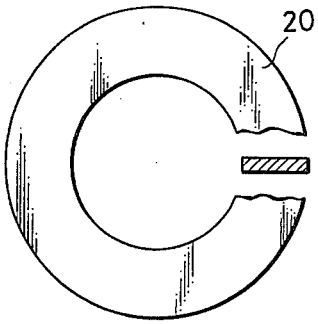
FIG. 9 shows a top plan view of a disinfectant-impregnated member, partly shown in cross section, which is containable between the container body of FIG. 1 and the lid member of FIG. 6.

The container body, which is shown generally by 1 in FIG. 1, when connected with the lid member, which is shown generally by 11 in FIG. 6, together comprise the container of the present invention. The disinfectant-impregnated member, which is shown as 20 in FIG. 9, can be fixedly sandwiched between the container body and the lid member and thereafter be inserted into a mouthpiece of a telephone.

Figure 4:
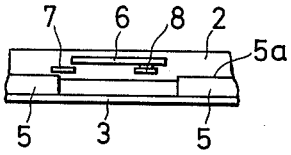
FIG. 4 shows a fragmentary side view of the inner circumferential portion of the container body of FIG. 1 as seen in the direction of arrow IV.

As can be seen from FIG. 4, the container body 1 comprises an outer frame 2 which is connected to a ring-shaped bottom plate 3 which is formed to have an opening 3*a* in the center thereof concentric with the frame 2. The opening 3*a* in fact allows for a person's voice to pass through the container body into the mouthpiece of a telephone. The bottom plate 3 serves to support thereon a disinfectant-impregnated member (see FIG. 9) and is provided with a number of spaced apart openings of desired contour, such as the triangular-shaped openings 3*b* shown in FIG. 1, in order to allow the volatile disinfectant from the member 20, when properly positioned, to enter into the telephone mouthpiece.

Figure 5:
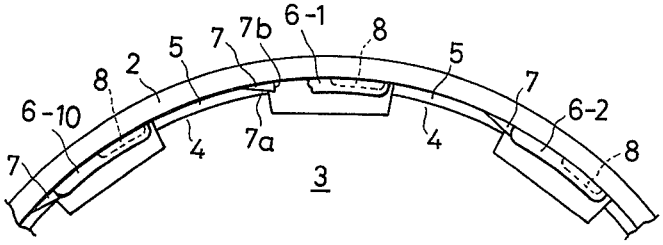
FIG. 5 shows an enlarged, fragmentary top plan view of the container body of FIG. 1.

The frame 2 includes on the upper part of its inner circumferential wall a plurality of equally spaced apart upper retaining means 6 – 1, 6 – 2, 6 – 3, . . . 6 – 10 with cut-away portions 4 of ring-shaped bottom plate 3 left therebetween. A plurality of circumferentially, equally spaced apart stepped portions (lower retaining means) 5 are positioned on bottom plate 3 at its outer circumference and connect with outer frame 2 in staggard relation to the positioning of the upper retaining means 6 – 1, 6 – 2, etc., as indicated in FIG. 5. Of course, the portions 5 could alternatively be positioned below the upper retaining means 6 – 1, 6 – 2, etc. The portions 5 serve to not only connect means 2 and 3, but also to retain the disinfectant-impregnated member 20 in appropriate position on bottom plate 3 (see FIG. 3).

Figure 3:
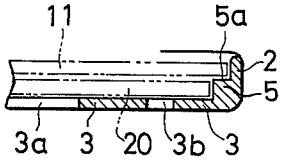
FIG. 3 shows a fragmentary cross sectional view of the container body of FIG. 1 taken along line III — III.

The disinfectant-impregnated member 20 is in the form of a flat, ring-shaped member which can thus be easily placed on the bottom plate 3 so as to be bounded by stepped portions 5 (see FIG. 3). The thickness of the flat, ring-shaped member is usually about the same as the height of the stepped portions 5 (again, see FIG. 3).

Figure 7:
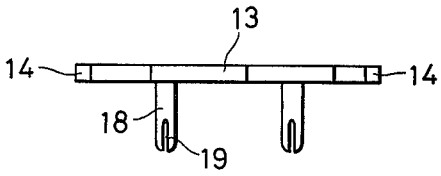
FIG. 7 shows a side view of the lid member of FIG. 6.
Figure 8:
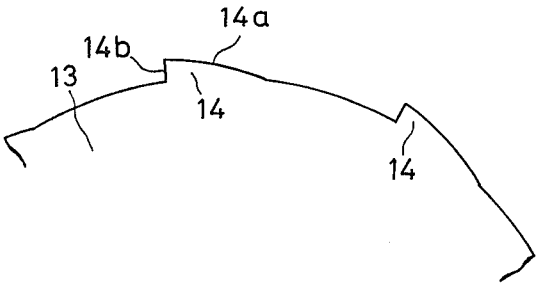
FIG. 8 shows an enlarged, fragmentary view of an outer circumferential portion of the lid member of FIG. 6.

The lid member 11 (see FIG. 6) is a substantially circular element having a reticulated body of flat cross-section (FIG. 7). The inner circular rim 15 encompasses a reticulated portion 12 which has the same diameter as the central opening 3*a* of the container body 1, and extending from the reticulated portion 12 (see FIG. 7) are a plurality of prongs 18 (only two being actually shown in FIG. 7) which function to extend through opening 3*a* of container body 1, actually near the circumference thereof, when the lid member 11 is connected thereto. By means of slots 19 in each of the prongs, the container of the present invention, retaining the disinfectant-impregnated member 20, can be fitted within and secured to telephone mouthpiece.

The outer rim 13 of the lid member 11, which is connected to inner circular rim 16 by means of reticulated portion 16 and which is concentric with the inner circular rim 15, includes a plurality of circumferentially spaced, small triangular teeth 14 which have their apexes directed radially outwardly of the lid member. The number of teeth correspond to the number of upper and lower retaining pieces 6 in the container body. Each tooth 14 has a slow slope portion 14*a* and a steep sloped portion 14*b*, i.e., directed almost radially inwardly of the lid member.

As can be best seen in FIG. 4, small projections 8 are provided under each upper retaining piece 6 on the container body, and associated triangular pawls 7 (see also FIG. 5) are also provided under each upper retaining piece 6 and spaced apart from projections 8. These pawls 7 are in fact positioned on the inner circumferential surface of circular outer frame 2 in an equally spaced relation and such that their steep slope portions 7*b* are adjacent one end of the upper retaining pieces 6 and their slow slope portions 7*a* extend away from associated projections 8. The edges 7*b* of the pawls 7 extend in a direction substantially radially of the container body.

In order to complete assembly of the inventive container, the disinfectant-impregnated piece 20 is positioned on bottom plate 3 of container body 1, and then lid member 11 is placed in container body 1 by positioning respective triangular teeth 14 in the cut-away portions 4 of bottom plate 3, which are located between upper retaining pieces 6, and on top of portions 5. Then lid member 11 is turned relative to container body 1, i.e., in a clockwise direction, such that the slow slope portions 14*a* of the respective teeth 14 will contact and ride over slow slope portions 7*a* of pawls 7 and then snap into retention between pawls 7 and projections 8, and beneath retaining pieces 8. Once in position, lid member 11 cannot be rotated in a counter-clockwise direction due to the abutment between steep slope portions 14*b* of the teeth on lid member 11 and steep slope portions 7*b* on pawls 7 on container body 1. Furthermore, continued rotation of lid member 11 in a clockwise direction is inhibited by engagement between slow slope portions 14*a* and projections 8.

Since the teeth of lid member 11 are thus fixed between pawls 7, projections 8 and retaining pieces 6, lid member 11 is fixedly retained in position within container body 1, and likewise disinfectant-impregnated member 20 is, in effect, locked in position.

According to the invention, a pawl 7 — projection 8 combination need not be utilized beneath each retaining piece 6; they may be utilized beneath only every other piece 6, although at least three such pawl 7 — projection 8 combinations are needed to provide adequate interlocking between lid member 11 and container body 1.

While the foregoing embodiment represents a preferred form of the present invention, it is clear that many modifications will occur to those of skill in the art and thus be within the spirit of the invention.

I claim:

1. A container for a disinfectant-impregnated member which is positionable in a telephone mouthpiece, the container comprising a container body having a bottom portion for supporting the disinfectant-impregnated member thereon and an annular outer frame connected to said bottom portion, said bottom portion defining a central circular opening therein and said annular outer frame being concentric with said central circular opening;

a substantially flat, circular lid member having a substantially reticulated structure and of sufficient size to cover said bottom portion of said container body, including said central circular opening;

said lid member including at least two prongs projecting from one of the substantially flat surfaces thereof and positioned so as to extend through said central opening of said container body when said lid member is fitted in said container body, said prongs being capable of fitting into perferations in a telephone mouthpiece, said lid member also including a plurality of circumferentially, equi-angularly spaced, triangular teeth having their apexes directed radially outwardly of the lid member, said triangular teeth respectively having a slow slope portion and a steep slope portion; and, said container body including a plurality of upper retaining pieces provided in the outer frame thereof in equi-angularly spaced relation so as to leave cut-away portions between each pair of retaining pieces, said retaining pieces being equal in number to the number of triangular teeth on said lid member; a plurality of small projections positioned under said upper retaining pieces and capable of engaging the slow slope portions of associated triangular teeth of said lid member when said lid member is positioned in said container body and rotated in one direction, thereby impeding the rotation of said lid member in said one direction relative to said container body; and a plurality of associated triangular pawls provided on the inner circumferential surface of said outer annular frame and below said upper retaining pieces and having their apexes directed radially inwardly of said container body, said triangular pawls having a slow slope portion and a steep slope portion, and said steep slope portion of respective pawls being capable of engaging the steep slope portion of associated triangular teeth of said lid member, thereby preventing the rotation of said lid member in a direction opposite said one direction, relative to said container body.

2. The container as defined in claim 1 wherein said bottom portion of said container body is connected to the annular outer frame thereof by means of a plurality of lower, circumferentially spaced, retaining pieces, said lower retaining pieces being formed as step-like portions having a height sufficient to correspond with the thickness of a disinfectant-impregnated member supported by said bottom portion, and positioned on said bottom portion of said container body so as to restrictively retain said impregnated member therebetween.

3. The container as defined in claim 1 wherein a single small projection is associated with a single triangular pawl below a single upper retaining piece, such that when said lid member is placed in said container body and said lid member is rotated in said one direction relative to said container body, an associated triangular tooth on said lid member will ride over an associated triangular pawl of said container body and thereafter become locked between an associated triangular pawl, an associated small projection and an associated upper retaining piece.

4. The container as defined in claim 3 wherein said outer annular frame of said outer annular frame of said container body includes at least six circumferentially, equi-angularly spaced retaining pieces; at least three small projections; and at least three circumferentially, equi-angularly spaced, triangular pawls associated with said small projections.

* * * * *